US007959146B2

(12) United States Patent
Gerlier et al.

(10) Patent No.: US 7,959,146 B2
(45) Date of Patent: Jun. 14, 2011

(54) BANKNOTE HANDLING

(75) Inventors: Andre Gerlier, Sciez (FR); Andreas Wuthrich, Bernex (CH)

(73) Assignee: MEI, Inc., West Chester, PA (US)

( * ) Notice: Subject to any disclaimer, the term of this patent is extended or adjusted under 35 U.S.C. 154(b) by 376 days.

(21) Appl. No.: 11/495,831

(22) Filed: Jul. 27, 2006

(65) Prior Publication Data

US 2007/0182090 A1 Aug. 9, 2007

(30) Foreign Application Priority Data

Jul. 27, 2005 (EP) ..... 05254686

(51) Int. Cl.
*B65H 83/00* (2006.01)

(52) U.S. Cl. ..... 271/3.03; 271/3.01; 271/245; 902/12; 209/534

(58) Field of Classification Search ..... 271/177, 271/180, 181, 3.01–3.02, 3.06, 3.09, 3.12, 271/3.13, 245, 246; 902/8, 9, 11, 12–17; 414/789.9, 790.7; 209/534; 194/206, 207
See application file for complete search history.

(56) References Cited

U.S. PATENT DOCUMENTS

| | | | | |
|---|---|---|---|---|
| 3,635,465 | A * | 1/1972 | Beery | 271/122 |
| 4,350,334 | A * | 9/1982 | Quinton | 271/274 |
| 4,363,584 | A * | 12/1982 | Kokubo | 414/788.5 |
| 4,476,664 | A | 10/1984 | Kroll et al. | |
| 4,555,104 | A * | 11/1985 | Fukuju et al. | 271/228 |
| 4,618,302 | A * | 10/1986 | Kokubo et al. | 414/789.9 |
| 4,909,499 | A * | 3/1990 | O'Brien et al. | 271/10.06 |
| 5,011,129 | A * | 4/1991 | Holbrook | 271/274 |
| 5,106,077 | A * | 4/1992 | Kawaguchi et al. | 271/302 |
| 5,267,826 | A * | 12/1993 | Peters | 414/789.9 |
| 5,435,542 | A * | 7/1995 | Van Pham et al. | 271/246 |
| 5,904,237 | A * | 5/1999 | Sander et al. | 198/502.2 |
| 5,927,936 | A * | 7/1999 | Arikawa et al. | 414/788 |
| 5,944,477 | A | 8/1999 | Shill et al. | |
| 6,170,822 | B1 * | 1/2001 | Kato et al. | 271/298 |
| 6,540,136 | B1 | 4/2003 | Ross | |
| 7,392,982 | B2 * | 7/2008 | Farmer et al. | 271/245 |
| 2002/0092905 | A1 | 7/2002 | Katou et al. | |
| 2003/0047601 | A1 | 3/2003 | Nomiyama | |
| 2004/0145111 | A1 | 7/2004 | Nishida et al. | |
| 2004/0217162 | A1 * | 11/2004 | Chigira et al. | 235/379 |
| 2005/0023747 | A1 * | 2/2005 | Dunlap et al. | 271/275 |
| 2005/0242497 | A1 * | 11/2005 | Ishikawa et al. | 271/273 |

FOREIGN PATENT DOCUMENTS

| | | | |
|---|---|---|---|
| CN | 1261194 | A | 7/2000 |
| CN | 1403359 | A | 3/2003 |
| CN | 1508056 | A | 6/2004 |
| EP | 0 907 152 | A2 | 4/1999 |
| EP | 1 028 399 | A | 8/2000 |
| EP | 1244075 | | 9/2002 |

(Continued)

*Primary Examiner* — Jeremy Severson
(74) *Attorney, Agent, or Firm* — Fish & Richardson P.C.

(57) ABSTRACT

Means for superposing a bundle of value sheets which have been misfed from a value sheet store is disclosed. Also disclosed is a value sheet handler which includes a first value sheet store for receiving value sheets from, and dispensing value sheets to, a user and a second value sheet store where the second value sheet store provides value sheets to resupply the first value sheet store. The handler may include means for detecting a misfeed from the second value sheet store and a bundle of misfed value sheets may be stored in a third store after superposition of the bundle, where it includes overlapping value sheets.

31 Claims, 11 Drawing Sheets

FOREIGN PATENT DOCUMENTS

| | | | |
|---|---|---|---|
| EP | 1321408 | | 6/2003 |
| EP | 1323656 | | 7/2003 |
| EP | 1 471 474 | A | 10/2004 |
| EP | 1 489 563 | A | 12/2004 |
| GB | 2282799 | | 4/1995 |
| JP | 03-259869 | | 11/1991 |
| JP | 2005-035765 | | 2/2005 |

* cited by examiner

BANKNOTE HANDLING

This invention relates to the handling of sheets of value such as coupons, cheques and banknotes, which are referred to herein simply as "banknotes". In particular, the invention relates to dispensing of banknotes from banknote stores.

Where banknotes are stored for automatic dispensing such as in change givers or vending machines, a number of different types of stores may be used, the type depending on the intended purpose of the store.

In one form of store, banknotes are stored in a stack where the banknotes are superposed. The arrangement is advantageous as it is compact but suffers from the disadvantage that due to friction and/or soiling of the banknotes, when the topmost banknote is dispensed from the stack, more than a single banknote may be dispensed.

Such stores are well known in the art and described, for example, in EP-A-1 323 656 and EP-A-1 244 075. For ease of reference, this type of store will be referred to herein as a "stack store".

To minimise the dispensing of more than a single banknote from a stack store, a number of mechanisms to be incorporated with the store have been proposed (see, for example, EP-A-1 244 075). However, these mechanisms may not be present and, if present, may not be completely effective.

Banknote handlers accept banknotes from users, store banknotes and dispense banknotes to users. Such handlers have a number of applications but are typically used for automatic transaction processing such as in vending machines.

Where a stack store is used in a banknote handler to dispense banknotes it is advantageous to recognise banknotes which have been misfed from the stack store and deal with them appropriately. This can prevent mispayment to users and prevent jamming of the handler.

There are at least two ways in which a banknote may be misfed from a stack store: firstly, where two (or more) banknotes are dispensed from the store and they are superposed; secondly, where two (or more) banknotes are dispensed from the store and at least one of the banknotes overlaps the other.

According to a first aspect, the invention extends to a banknote handler which includes means for superposing overlapping banknotes. Superposed banknotes may be more readily stored and transported than overlapping banknotes. The means for superposing overlapping banknotes may further be utilised to superpose overlapping banknotes in a bundle of banknotes where slippage has caused mis-registration of the bundle, for example, during transport to or from a banknote bundler.

The superposing means may include a stopper and a driving means wherein the driving means drives the banknotes against the stopper to superpose them.

Although it would be desirable to have the banknotes superposed so that there is no overlap, this may not, due to other design considerations, always be possible. What is important is that the degree of overlap is reduced so that the bundle of banknotes can be more readily stored and transported.

Where banknotes have been misfed from a store (such as a stack store), they cannot be dispensed to users and therefore it is desirable to store the misfed banknotes.

According to a further aspect, the invention extends to a banknote handler which includes a first banknote store from which banknotes are dispensed, means for determining when banknotes are misdispensed from the first store, means for superposing banknotes misdispensed from the first store and a second store for storing the superposed banknotes.

The means for determining when banknotes are misdispensed from the first store may include means for determining whether overlapping banknotes have been dispensed from the first stack store by, for example, measuring a length of the banknotes dispensed.

The means for determining when banknotes are misdispensed from the first store may include means for determining whether superposed banknotes have been dispensed from the first stack store. If superposed banknotes are dispensed from the first store, there is no need to superpose them prior to storage in the second store.

The second store may additionally store banknotes supplied by users which are recognised as forgeries.

The second store may be a removable stack store and may be adapted so that it receives banknotes but does not dispense banknotes when installed in the handler. Such stores are known in the art and referred to herein as "cashboxes". Cashboxes are constructed so that they can receive banknotes from the handler and have added security features so that, once removed from the handler, the stored banknotes can only be accessed by an authorised person.

A further type of banknote store is arranged so that it can receive, store and dispense banknotes when installed in a banknote handler. In a particular example of such a store, the banknotes are arranged sequentially on a support member which may, for example, be wound in a spiral. This arrangement ensures that a single banknote is dispensed at a time but is able to store fewer banknotes per unit volume than the stack store described above. These stores also permit access to any particular banknote in the store so banknotes of different denominations may be stored and dispensed on demand. Such stores are well known in the art and described, for example, in EP-A-1 321 408. For ease of reference, stores such as these, which can be automatically replenished by, and dispense, individual banknotes will be referred to herein as "recyclers".

It has been proposed to provide banknote handlers which accept, store and dispense banknotes and which include a recycler which receives banknotes from a user and stores banknotes to be dispensed to a user.

During operation of the handler, as banknotes are received and dispensed, it becomes necessary to replenish the store of banknotes to be dispensed because, for example, banknotes have been dispensed as change. This operation is performed by a route person who periodically visits the handler. Although it may be possible to replenish the handler with a recycler, it is preferable to supply this as a stack store as the greater capacity of this store reduces the number of times a route person is required to visit the handler.

A further aspect of the present invention extends to a banknote handler which comprises first and second banknote stores wherein the first banknote store is used to dispense banknotes to a user and to store banknotes received from the user, and the second stack store is used to resupply the first banknote store.

The first store may be a recycler. "Payouts" are stack stores which are adapted to dispense banknotes but do not receive banknotes when installed in the handler. Payouts often have additional security features which prevent access to the stored banknotes by the route person (or anyone not authorised) but banknotes to the handler once installed in the handler.

The second banknote store is preferably a payout.

Payouts, in common with other stack stores, suffer from the disadvantage that more than a single note may be dispensed from the payout at a time, resulting in possible overpayment.

Therefore the handler may comprise means for determining whether more than a single banknote is dispensed from the second store, ensuring that when the second store is used to resupply the first store only a single banknote is fed to the first store at a time.

The handler may include means for authenticating and denominating the banknote supplied by the second store to the first store. The content of the first store is then known and the output of the second store can be audited.

By using this technique, the apparatus is operable to verify that the notes from the second store are suitable for dispensing (i.e. not misfed or of the wrong denomination) and then sent to the first store for subsequent dispensing, thus avoiding the problems of prior art stores.

The resupply of the first store by banknotes stored in the second store can be performed while the handler is not dealing with transactions (i.e. during "down time"), for example, at night when there are few or no users or immediately after the second store has been installed. The time when this is done may be scheduled. This enables the advantages of the invention to be achieved without needing to spend time during a transaction authenticating the banknotes and/or checking for misfeeds when banknotes are dispensed to a user.

When the contents of the first store are known, the resupply of banknotes to the first store may be performed when there are fewer than a predetermined number of banknotes in the first store.

The means for authenticating and denominating the banknote supplied from the second store to the first store may also authenticate and denominate banknotes received from a user.

The means for authenticating and denominating banknotes may be adapted to determine whether more than one banknote is dispensed from the second store by determining whether superposed banknotes have been dispensed.

The handler may include a third store for storing banknotes which have been incorrectly dispensed from the second store (e.g. where more than a single banknote is dispensed at a time).

The handler may further include means for superimposing overlapping banknotes. The banknotes are preferably superposed prior to being stored in the third store.

The third store may additionally store banknotes received from users which have been recognised as forgeries.

An arrangement embodying the invention will now be described by way of example with reference to the accompanying drawings in which.

Figure 1:
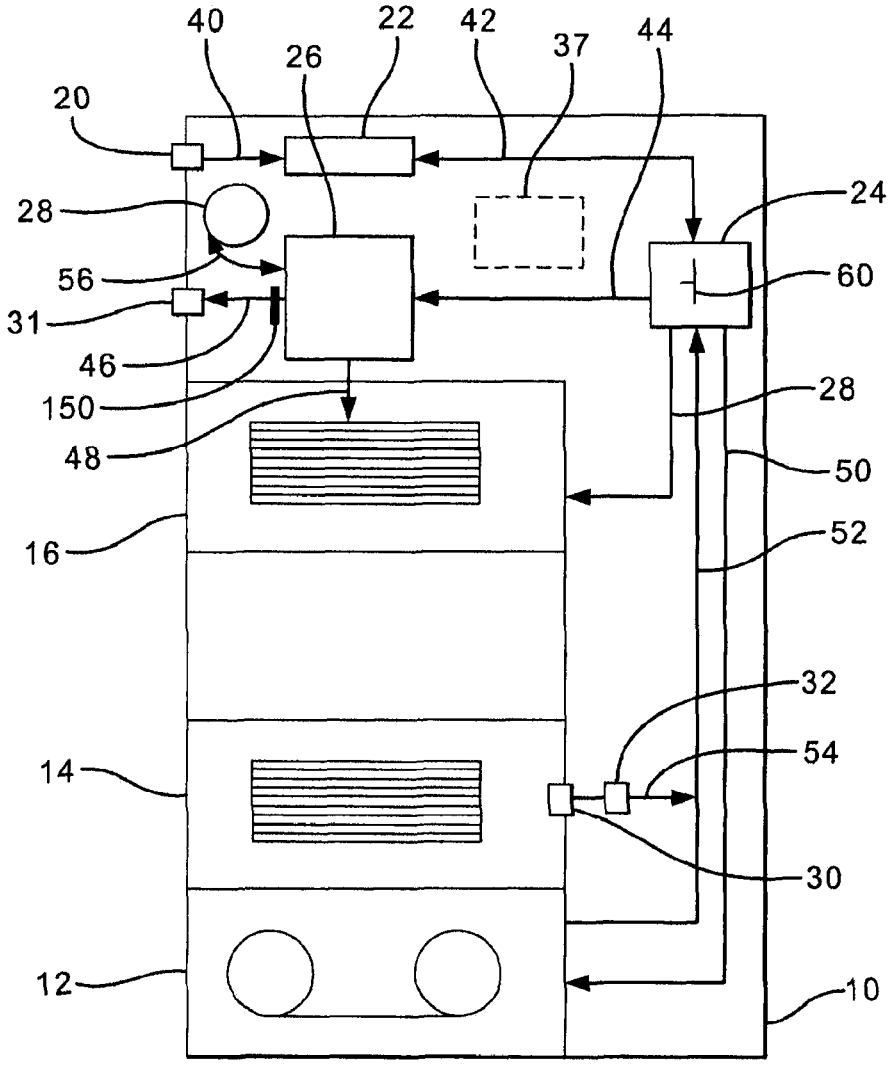
FIG. 1 is a schematic diagram of a banknote handler according to the invention.

FIG. 1 is a schematic diagram of a banknote handler 10 which includes a recycler 12, a payout 14 and a cashbox 16. The handler 10 further includes a banknote inlet 20, a justifier 22, an authenticator 24, a transport 26, a bundler 28 and a banknote outlet 31.

Authenticator 24 acts to authenticate and denominate banknotes passing therethrough. Such authenticators are well known in the art and the one used in the embodiment illustrated is of the type described in EP-A-1 321 904. Transport 26 will be described in greater detail with reference to FIGS. 2 to 7.

Although transport 26 is the only means illustrated in FIG. 1 of conveying banknotes from one location to another, it is to be realised that handler 10 includes numerous other transport means well known in the art but not illustrated here for moving banknotes from one location to another.

The operation of the handler 10 is controlled by a controller 37. The controller 37 determines what action to take if a banknote fails or passes authentication and controls the operation of the banknote stores recycler 12, payout 14 and cashbox 16 (the dispensing by, and receiving of, banknotes by the various banknote stores). The controller 37 also controls the transport of banknotes between various locations of the handler 10 as well as the operation of the justifier 22, the authenticator 24, the transport 26 and the bundler 28.

During operation of the banknote handler, a user inserts a banknote into the inlet 20 and this is passed along path 40 to justifier 22 which ensures that the banknote has the correct orientation before it is passed on to authenticator 24 along path 42. The authenticator 24 determines whether the banknote is valid or not. If the banknote is not valid it is conveyed to transport 26 along path 44. The banknote is then either returned to the user along path 46 or, in an alternative mode of operation, redirected to the cashbox 16 via path 48, as discussed below. In certain countries it is a legal requirement to retain forged banknotes.

If the banknote passes authentication, it is conveyed along path 50 and stored in recycler 12 or directed to the cashbox 16 via the transport 26 and path 48. The controller 37 determines where the authenticated banknote is to be stored and only directs it to the recycler 12 if it determines that the recycler 12 requires banknotes of that particular denomination. It is to be realised that the controller 37 maintains a record of the banknotes stored in, and dispensed from, recycler 12 to determine whether banknotes of that denomination are required.

Banknotes are also dispensed to users from recycler 12 along paths 54, 52, 44 and 46 according to the requirements of the handler. If, for example, the handler acts as part of a vending machine, the handler will receive banknotes as payment and dispense banknotes as change. Therefore, it becomes necessary to replenish the handler's banknote supply to ensure enough banknotes are available in appropriate denominations for change.

A route person regularly visits the handler 10 and provides payout 14 which is preloaded with banknotes and removes any empty or partially empty payouts. The route person also removes any cashboxes and replaces these with empty cashboxes. The payout 14 includes additional security features to ensure that the route person is not able to access the stored banknotes but once inserted, the stored banknotes are available to the handler 10. Once payout 14 has been inserted into the handler 10, it is used to replenish recycler 12 in the following manner.

Banknotes are dispensed from payout 14 along path 54. Two sensors 30 and 32 are disposed along path 54. Sensor 32 detects a leading edge of the banknote and sensor 30 a trailing edge of the banknote as it moves along path 54.

The distance between the sensors 30 and 32 is known and therefore the controller 37 calculates the length of the banknotes dispensed from payout 14. The controller 37 compares the measurements made by the sensors 30 and 32 to the expected length of the banknote. Where the measured length exceeds the expected length, the controller 37 determines that overlapping banknotes have been dispensed.

Currencies vary in their characteristics. In some currencies, such as the US Dollar, all banknotes have the same dimensions whereas other currencies, such as the Euro, employ different dimensions for banknotes of different denominations.

If the handler 10 is dealing with banknotes which are all the same size, no adaptations for different banknote denominations are necessary. However if the handler is dealing with banknotes which differ in size according to denomination the controller 37 must be informed of the length of the banknote dispensed from payout 14.

In the embodiment illustrated the payout includes an electronic tag (not shown) which communicates with the controller 37 to indicate the currency and denomination of the banknotes stored in the payout 14. The handler 10 includes further payouts (not shown), one for each size of banknote. It is to be realised that each of these payouts operate with the handler 10 in the manner described with reference to payout 14.

Although the apparatus illustrated and discussed above measures the length of the banknotes dispensed to determine whether overlapping banknotes have been dispensed it is to be realised that measurements of other dimensions are also possible and the appropriate measurement will depend on the orientation of the banknotes in the stack 14 and the manner in which these are dispensed from that stack.

Path 54 leads to path 52 and the banknotes are then directed along this path to the authenticator 24. If it is determined that overlapping banknotes have been dispensed from payout 14, the controller 37 operates the gate 60 which, in the embodiment shown, is integral with the authenticator 24, to direct the overlapping banknotes to transport 26 along path 44 which, in turn, redirects the overlapping banknotes into the cashbox 16 along path 48 (as described below). This is done without authenticating or denominating the banknotes.

If the length of the dispensed banknote agrees with the expected value, the controller 37 operates gate 60 so that the banknotes are conveyed along path 42 to justifier 22 where they are justified and then back along path 42 to authenticator 24. Authenticator 24 authenticates and denominates banknotes by measuring the light reflection and transmission characteristics of the banknote. By performing these measurements on the banknote dispensed from payout 14, the authenticator can determine, in addition to validating and denominating a single banknote, whether superposed banknotes have been dispensed.

If authenticator 24 determines that superposed banknotes have been dispensed from payout 14, these are sent to transport 26 which redirects them into the cashbox 16.

The cashbox 16 is adapted to receive banknotes from the handler and does not dispense banknotes. When the cashbox is full, it is removed by a route person and therefore includes security features which ensure that the route person is not able to access the stored contents unless authorised.

If the controller 37 determines that a single banknote has been dispensed from the payout 14, the denomination is determined and recorded by the controller 37 and the banknote is passed along path 52 to recycler 12.

This procedure ensures that any banknotes stored in recycler 12 received from payout 14 have been authenticated and that if multiple banknotes were misdispensed from payout 14 they are stored in cashbox 16 instead of recycler 12. The banknote is directed to cashbox 16 if the authenticator 24 is unable to authenticate or denominate the banknote received from the payout 14.

The controller 37 will continue the process until the recycler has been replenished or until the payout is empty.

This also ensures that banknotes stored in the recycler 12 can be dispensed directly to users along paths 54, 44 and 46 without the need to authenticate or denominate the banknotes prior to dispensing.

Although the use of the payout 14 to replenish the recycler 12 has significant advantages, the process of ensuring that only single banknotes are fed from the payout 14 to the recycler 12 does occupy some time and it would be disadvantageous to do this at the time of a transaction. Therefore, the controller 37 includes a clock (not shown) and is set to schedule the replenishment for a time when the handler is not busy carrying out transactions. This will depend on the specific transactions which the handler is performing but would typically be at night or in the early morning.

To determine the optimum time for performing the replenishment, the controller 37 maintains a record of all the past transactions and the time when they occurred. By analysing this record, the controller determines when the handler is least busy and schedules the replenishment for this time. It is to be realised that this may not be the same time for each day of the week and therefore the controller can schedule the replenishment for different times on different days.

The controller can also be manually adjusted to set the replenishment for a particular time.

Additionally, because the controller 37 monitors the banknotes stored by, and dispensed from, the recycler 12, replenishment can be set to take place when fewer than a predetermined number of banknotes of a particular denomination are stored in the recycler 12 or if the recycler's ability to dispense change is effected because it lacks banknotes of a particular denomination.

In an alternative embodiment, the controller 37 replenishes the recycler 12 from the payout 14 as soon as the payout 14 is inserted.

As mentioned, the controller 37 maintains a record of the transactions carried out by the handler 10 and of the banknotes stored in the recycler 12. This information is communicated to the routeperson, for example by means of a computer network (not shown).

The banknotes of certain currencies have the same dimensions for different denominations (as do other value sheets such as coupons). When the handler operates with such banknotes, the payout 14 can be packed with different denominations of banknotes.

The contents of the recycler 12 may reflect the need for a particular denomination of banknote. When this occurs, the payout is packed with the required denomination at the top so that these banknotes can be quickly delivered to the recycler 12 when the replenishment occurs. To ensure that this occurs as quickly as possible, the controller 37 will set the replenishment to take place as soon as the payout 14 is installed.

A banknote store capable of storing banknotes with different dimensions may be used in place of the payout 14.

The controller 37 is also able to empty the recycler 12 and the payout 14 and store their contents in the cashbox 16. The cashbox 16 can then be removed and placed in a secure store such as a safe. This is particularly advantageous where the handler 10 is located in a non-secure environment and is to be left unguarded, for example, at night.

Figure 2:
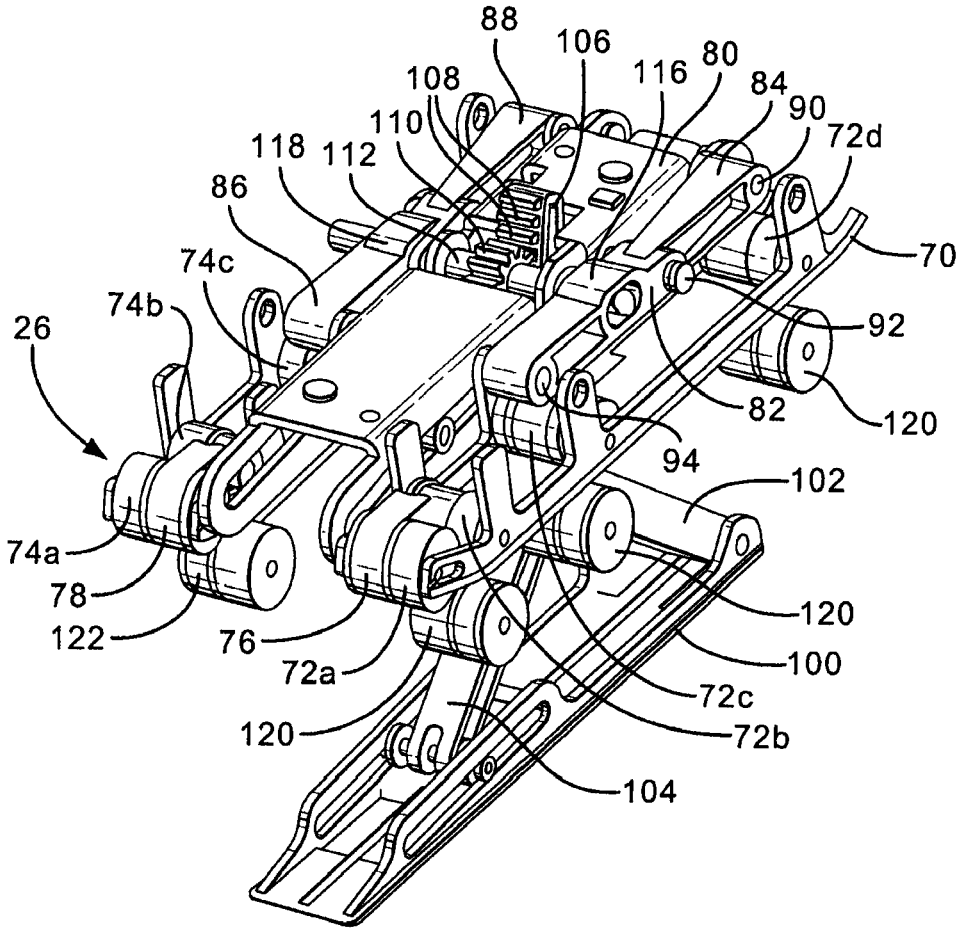
FIG. 2 is a perspective view of a detail of a transport for use in the handler of FIG. 1.

FIG. 2 illustrates the transport 26 used in the handler 10 of FIG. 1. The transport 26 includes a mobile chassis 70 to which a plurality of rollers 72*a*, 72*b*, 72*c* and 72*d* are attached to a first side and corresponding opposing rollers 74*a*, 74*b*, 74*c* and 74*d* (not shown) are attached to the opposite side. Belts 76 and 78, shown in partial detail in FIG. 2, engage with respective rollers 72*a*, 72*b*, 72*c* and 72*d*; and 74*a*, 74*b*, 74*c* and 74*d* and act to convey banknotes when the rollers rotate.

The transport 26 further includes an immobile chassis 80. Levers 82, 84, 86 and 88 connect mobile chassis 70 to immobile chassis 80 with, for example, lever 84 connected to the mobile chassis 70 at point 90 and connected to immobile chassis 80 at point 92, lever 82 is also connected to the immobile chassis at point 92 and to the mobile chassis at point 94. Levers 86 and 88 are similarly attached to the immobile and mobile chassis. Although not illustrated in FIG. 2, shafts connect the levers to the mobile chassis.

Rollers 120 and 122 are attached to the immobile chassis 80. Belts 121 and 123 (see FIGS. 4) engage with respective rollers 120 and 122 and banknotes are transported by being sandwiched between the belts 76 and 121 on one side of the transport 26 and between belts 78 and 123 on the other side.

The transport 26 also includes a piston 100 connected to pantograph 102.

Figure 3:
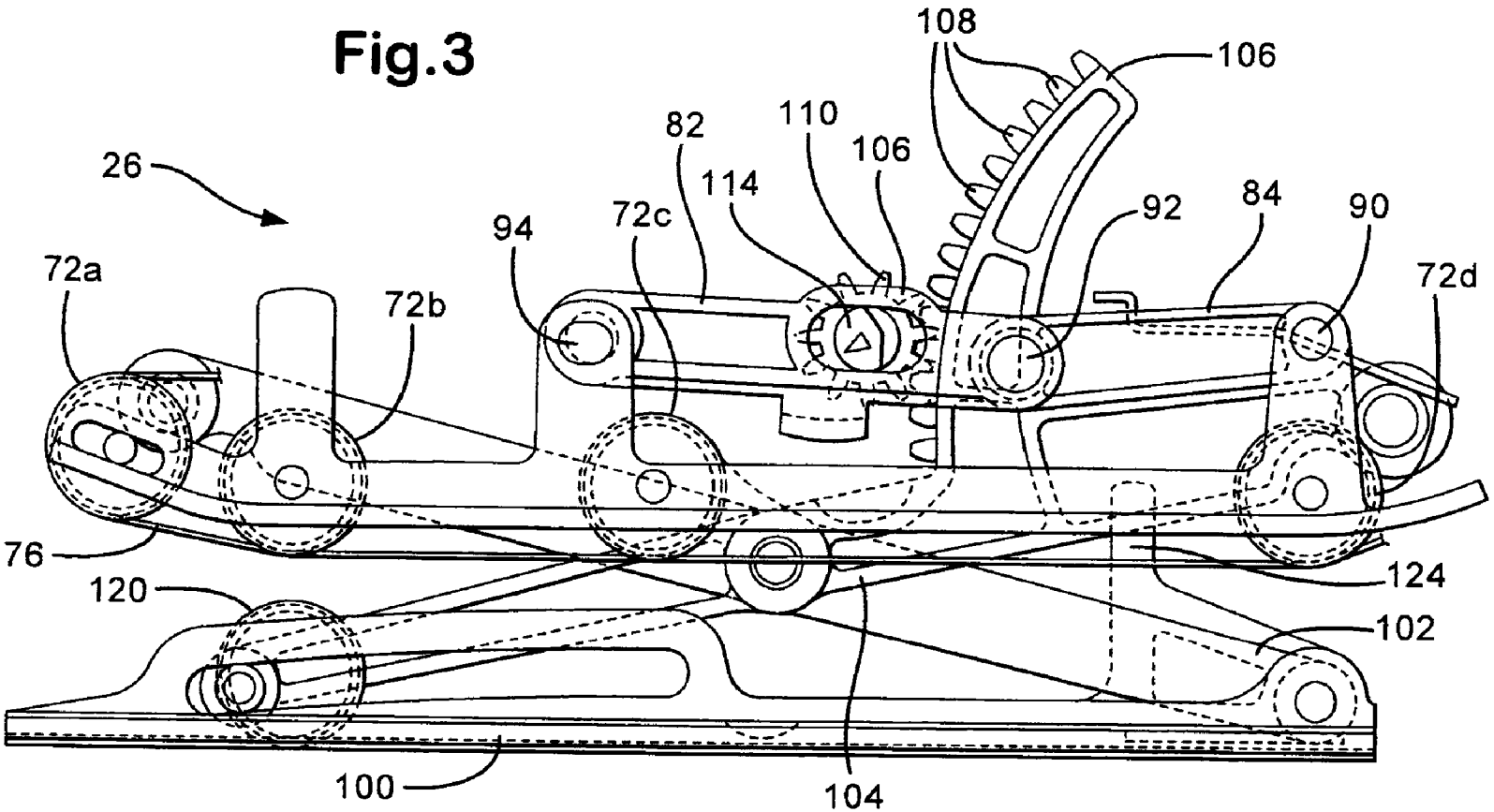
FIG. 3 is a side view of a detail of the transport of FIG. 2.

As illustrated in FIGS. 2 and 3, pantograph 102 includes a cross-bar 104 to which an arm 106 having cogs 108 is attached. Cogs 108 engage with gear 110. Gear 110 is disposed on a drive shaft 112 which also includes two cams 114 disposed in recesses 116 and 118 of respective levers 82 and 86. One of the cams 114 is shown in FIG. 3.

As drive shaft 112 rotates, gear 110 rotates, causing arm 106 to move up and down (with reference to FIG. 3) relative to immobile chassis 80, depending on the direction of rotation. This in turn causes the piston 100 to be raised or lowered.

Figure 4A:
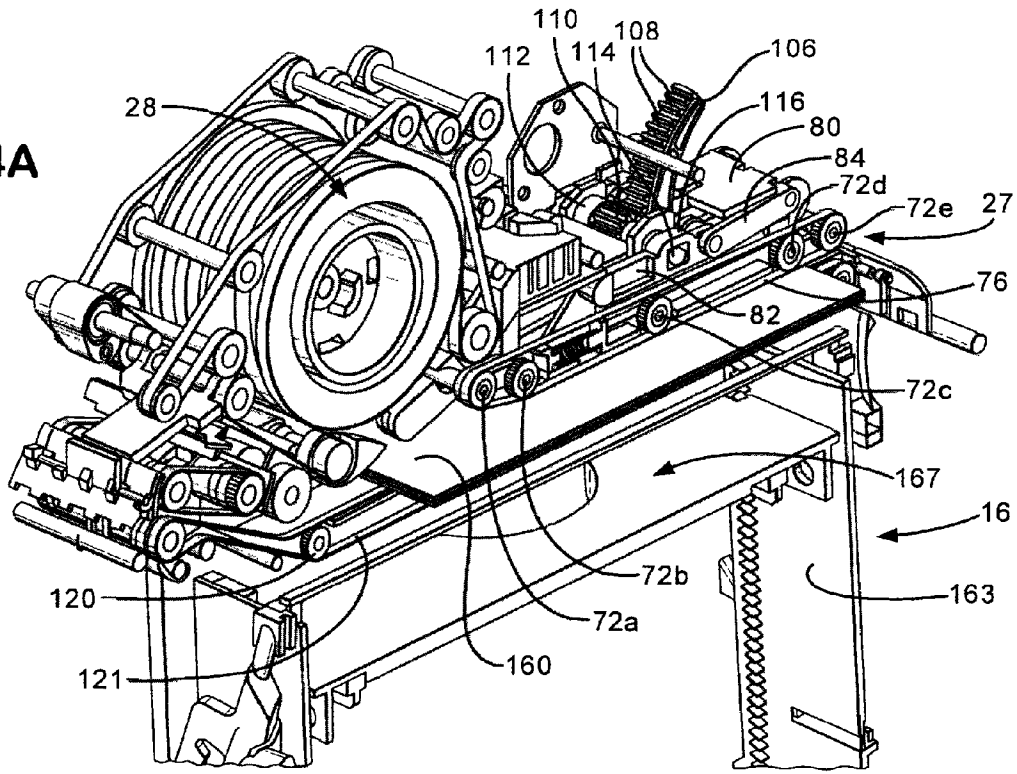
FIG. 4A is a perspective view of an alternative embodiment of a transport installed in the handler depicted in FIG. 1 showing details of the transport, bundler and cashbox.

FIG. 4A illustrates an alternative embodiment of a transport 27 installed in the banknote handler 10 illustrated in FIG. 1. A portion of the cashbox 16 is illustrated comprising a frame 163 and a pressure plate 167 which supports a banknote stack and which moves relative to the frame 163 in dependence on the height of the banknote stack.

The transport 27 differs from transport 26 illustrated in FIGS. 2 and 3 by the addition of an extra roller 72*e* attached to the immobile chassis 80 which acts to tension the belt 76. A corresponding roller 74*e* is provided on the other side of the transport 27 (not visible in this Figure). A banknote bundle 160 is engaged by belts 76 and 121.

It is to be realised that transport 27 does not differ functionally from transport 26 and all disclosures apply equally to both, unless otherwise stated. Like numerals are used to denote like features.

Also illustrated in FIG. 4A is the bundler 28 which receives banknotes from the transport 26 and provides bundles of banknotes to the transport 27. A diverter 57 is operated by the controller 37 to direct banknotes to or from the bundler 28 or to the outlet 31.

Figure 4B:
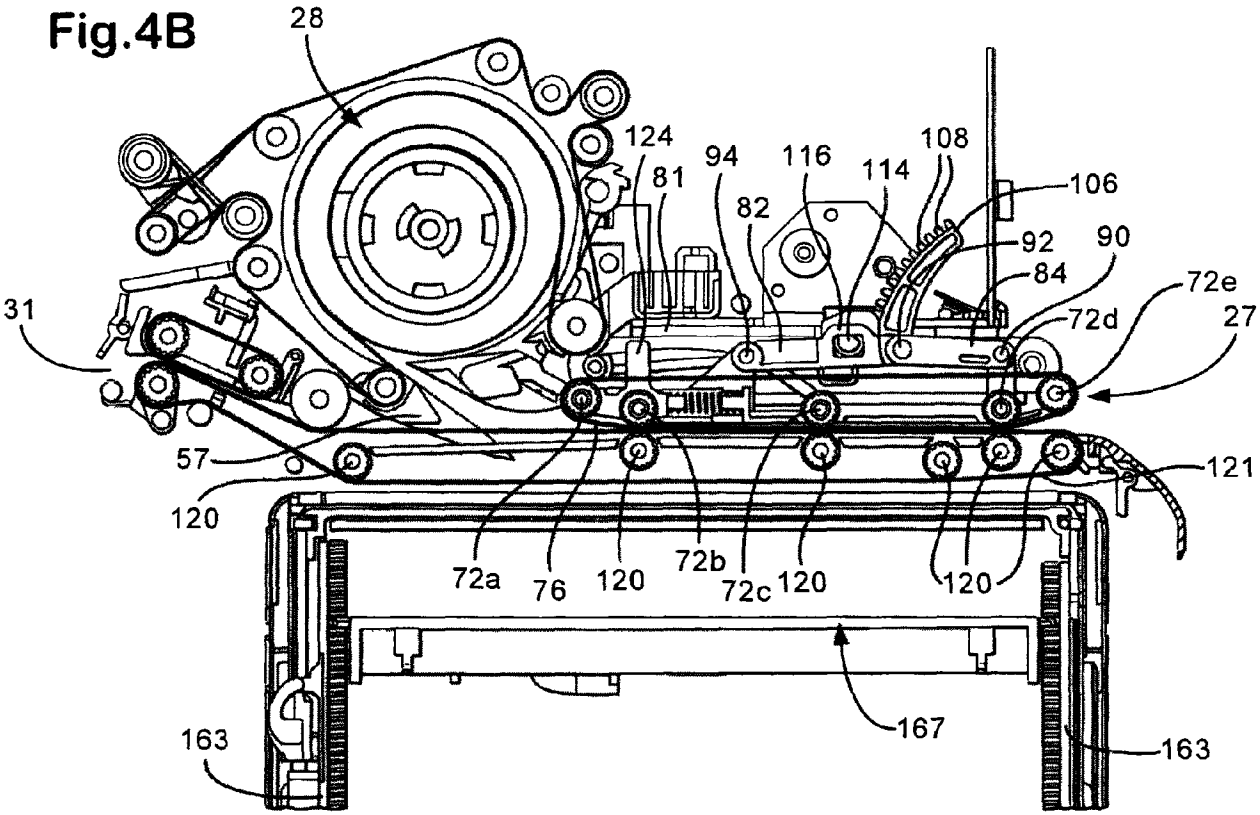
FIGS. 4B to 4E are side views of the transport of FIG. 4A showing various configurations of the transport.
Figure 4C:
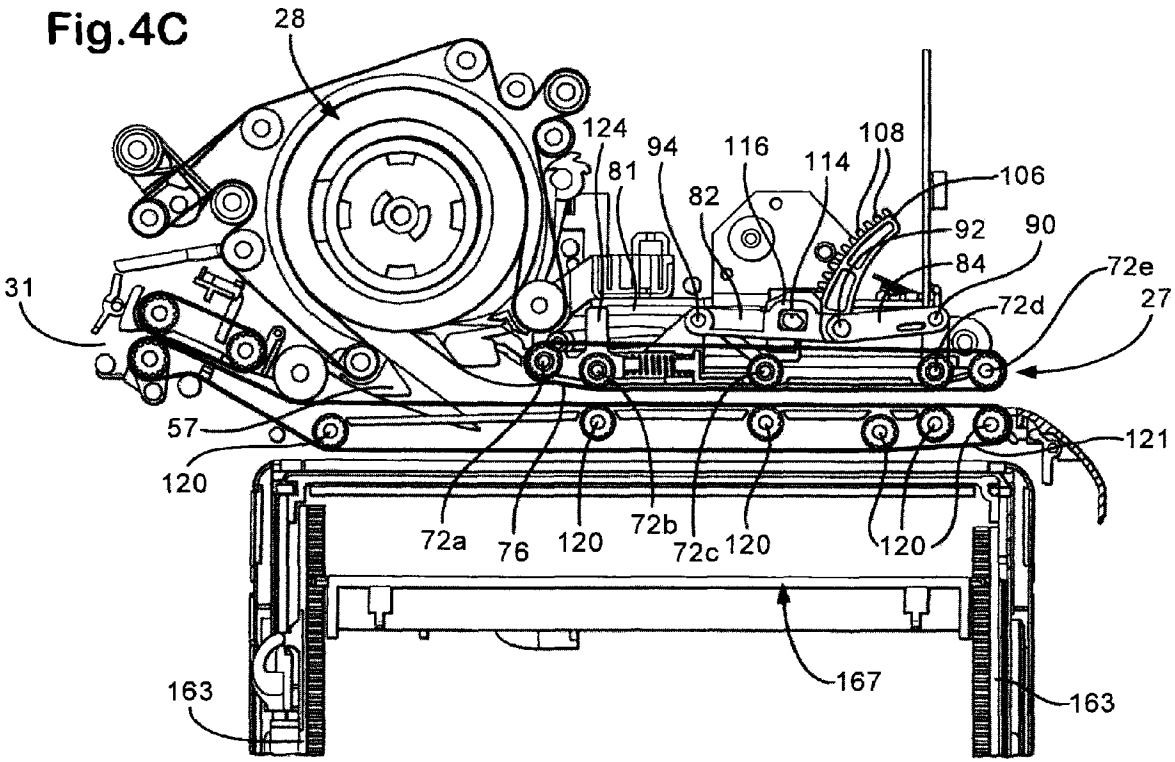
Figure 4D:
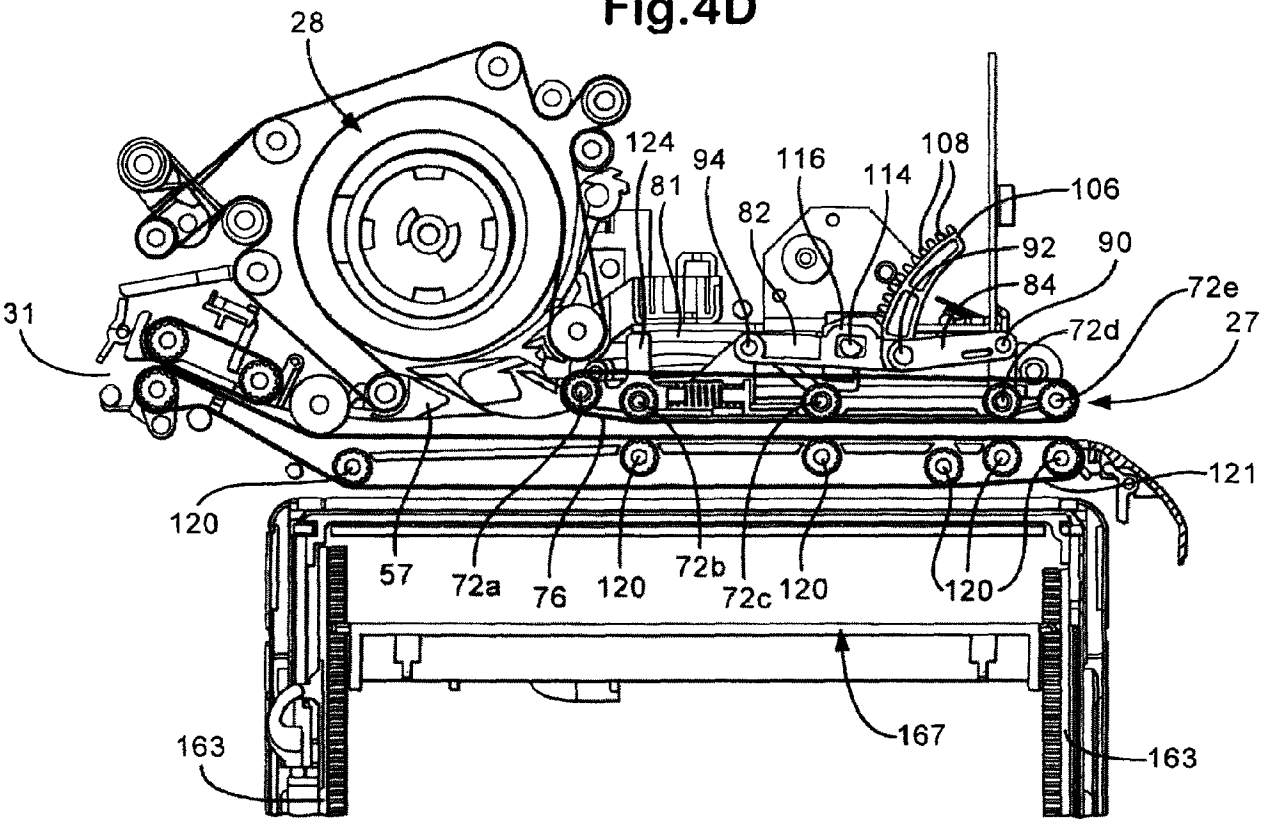

Transport 27 has three configurations, each corresponding to a different mode of operation. Rotation of the drive shaft 112 moves the transport 27 between the configurations. This will be explained with reference to FIGS. 4B to 4D FIGS. 4B and 4C are a side view of the transport 27, bundler 28 and cashbox 16 and illustrate the transport in a first configuration. In this configuration, the arm 106 is in a rest position and the mobile chassis is in such a position that the rollers 72*b*, 72*c* and 72*d* (as well as rollers 74*b*, 74*c* and 74*d*, although not shown) are orientated so that belts 76 and 121 (and belts 78 and 123 although not shown) are in contact with one another.

Each of the rollers 72*b*, 72*c*, 72*d*, 74*b*, 74*c* and 74*d* are biased by springs (not shown) in a downward direction but move upwards against the action of these springs. As a result, when the transport 27 is in the configuration shown in FIG. 4B, single banknotes can be transported as can bundles of banknotes; the biasing to the upper rollers provided by the springs ensuring that the additional height of the bundle can be accommodated while the upper belts 76 and 78 engage the upper banknote of the bundle with sufficient force to transport the bundle.

FIG. 4C illustrates the orientation of upper rollers 72*b*, 72*c* and 72*d* when the transport 27 transports a bundle of banknotes, although the bundle is not shown. The arm 106 has not moved relative to the configuration shown in FIG. 4B.

FIG. 4D illustrates the second configuration of the transport 27 when the drive shaft 112 has rotated so that cams 114 rotate within respective recesses 116 and 118 which causes point 94 to lift relative to point 92. This, in turn, causes the mobile chassis 70 to pivot relative to point 92 lowering roller 72*d* and raising rollers 72*a*, 72*b* and 72*c*. The mobile chassis 70 will continue to pivot about point 92 until the abutment 124 of the mobile chassis is brought into contact with plate 81 of the immobile chassis 80.

The controller 37 stops movement of the mobile chassis at the point where abutment 124 comes into contact with plate 81. In the embodiment shown this is done by turning the drive shaft 112 through a predetermined rotation. In an alternative embodiment, the transport 27 includes sensors to sense when the abutment 124 comes into contact with plate 81.

The handler 10 also includes a stopper 150 which is shown here in its operational position. This is discussed below with reference to FIG. 6.

Figure 4E:
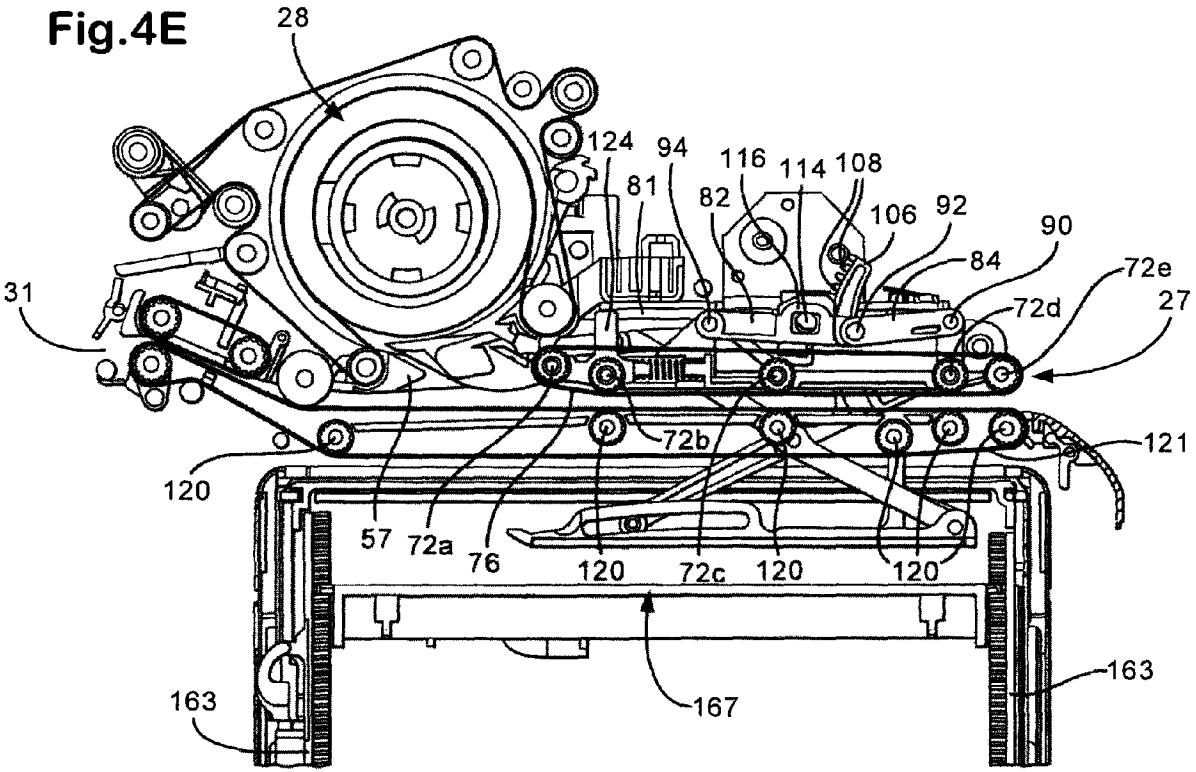

FIG. 4E shows the third configuration of the transport 27. As the drive shaft 112 continues to rotate, rotating cams 114 within recesses 116 and 118, contact between abutment 124 and plate 81 causes the mobile chassis 70 to pivot about the point of contact between the abutment 124 and the plate 81, thereby moving the back roller 72*d* upwards until the mobile chassis 70 reaches the orientation shown in FIG. 4E. This continued rotation of the drive shaft 112 also causes the piston 100 to be lowered.

By rotation of the drive shaft 112, the transport 27 can be moved between the configurations shown in FIGS. 4B to 4E.

To allow the raising and lowering of the mobile chassis 70, lost motion is permitted at point 94 to allow levers 82 and 84 to move relative to the immobile chassis 80.

In the above discussion, reference has been made primarily to rollers 72*b*, 72*c*, 72*d* and 120 disposed on one side of the transport. The attachments and articulation described above apply also to the rollers 74 and 122 attached to the other side of the transport.

The operation of the transport will now be described with reference to FIGS. 5 to 7.

The transport has the following modes of operation. In a first mode, corresponding to the configuration illustrated in FIGS. 4B and 4C, when the piston 100 is in a rest position, the transport operates to transport single banknotes to a user via path 46 and outlet 31 or to the bundler 28. In this mode, the transport also receives bundles of banknotes from the bundler 28 and delivers these bundles to a user.

In a second mode, corresponding to the first configuration illustrated in FIG. 4D, the transport 26 acts to superpose overlapping banknotes by driving a bundle against a stopper 150.

In a third mode, corresponding to the first configuration illustrated in FIG. 4E, the transport 26 acts to deliver a bundle of superposed banknotes (or a single banknote) to the cashbox 16.

Figure 5:
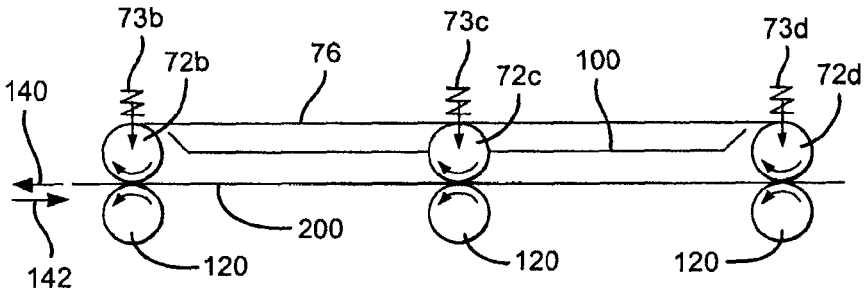
FIG. 5 is a schematic side view of a detail of the transport of FIG. 2 illustrating a first mode of operation.

FIG. 5 illustrates the transport 26 when the piston 100 is in a rest position (the first mode of operation). In this position, the rollers 72*b*, 72*c* and 72*d*, and the rollers 120, are positioned so that the transport 26 conveys banknote 200 in direction 140 or 142 depending on the direction of rotation of the rollers. In this configuration, the transport 26 conveys single banknotes to a user via path 46 and outlet 31 (FIG. 1).

Handler 10 includes a bundler 28 which receives individual banknotes from the transport 26 and arranges them in bundles so that change may be dispensed to the user in a single operation. The transport 26 includes springs 73*b*, 73*c* and 73*d* attached to corresponding rollers 72*b*, 72*c* and 72*d* biasing the rollers 72*b*, 72*c* and 72*d* downwards (although not shown, rollers 74 are similarly biased). Therefore, in the mode illustrated in FIG. 5, the transport is able to direct single banknotes to the bundler 28, receive a bundle of banknotes from the bundler 28 via path 56 and direct the bundle to a user (as well as transporting single banknotes to the user). Springs 73*b*, 73*c* and 73*d* ensure that belts 76 and 78 engage with single banknotes and with bundles of banknotes.

Figure 6A:
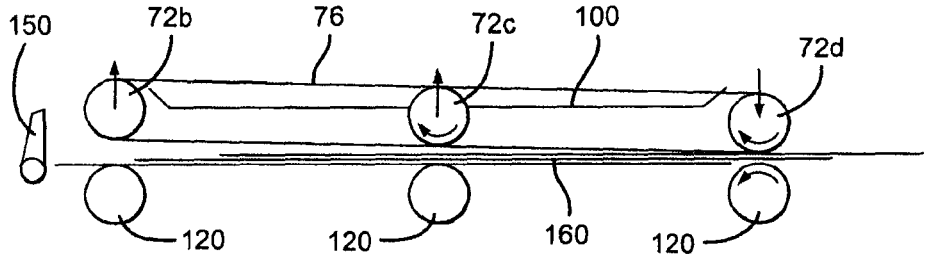
FIGS. 6A and 6B are schematic side views of a detail of the transport of FIG. 2 illustrating a second mode of operation of the transport.
Figure 6B:
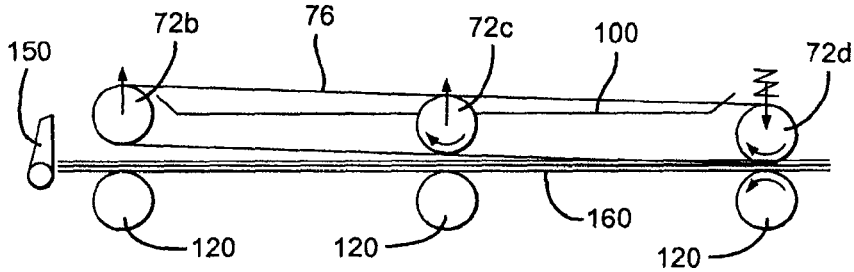

FIGS. 6A and 6B illustrate the second mode of operation of the transport 26, which occurs when the transport is in the configuration illustrated in FIG. 4D.

When the sensors 30 and 32 indicate that overlapping banknotes have been dispensed from store 14, the controller 37 operates the rotation of the drive shaft 112 to place the transport 26 in this configuration. The controller 37 also places the transport 26 in this configuration when a bundle of banknotes is received from the bundler 28 and slippage has caused mis-registration of the bundle.

The handler 10 includes a stopper 150 moveable between an operational position (illustrated in FIGS. 4D, 6A and 6B) where it blocks the movement of banknotes and a non-operational position in which it allows movement of banknotes to the outlet 31.

With reference to FIG. 1, the stopper 150 is disposed close to the banknote outlet 31 of handler 10. The stopper is dimensioned so that when in the operational position, the banknote path 46 is blocked. This prevents the insertion of foreign objects into the handler 10. To reduce the risk of damage and theft the controller 37 maintains stopper 150 in the operational position unless banknotes are being dispensed to a user.

When the transport 26 receives a bundle 160 of overlapping banknotes dispensed from stack 14, the controller 37 moves the stopper 150 into the operational position.

Initially, the roller 72*d* engages with the topmost banknote of the bundle 160 and moves this banknote until it abuts the stopper 150. The roller 72*d* acts on the banknotes of the bundle to superpose them in one of two ways, depending on the overlap.

If the topmost banknote overlaps an underlying banknote with a trailing edge (with reference to the direction it is being conveyed), the underlying banknote is conveyed together with the topmost banknote by friction until it abuts the stopper (if not conveyed by friction, the underlying banknote will be conveyed in the manner described below). The underlying note is kept in place by the stopper and the action of the roller 72*d* on the topmost banknote overcomes the friction between the notes and the topmost note will move relative to the underlying note until the two are superposed.

If the topmost banknote overlaps an underlying note with a leading edge, the roller 72*d* will act on the topmost note and move the topmost banknote until it abuts the stopper 150. The distance between the roller 72*d* and the stopper 150 is set so that once the topmost banknote abuts the stopper 150, the roller 72*d* will engage with the next underlying banknote and move this until it abuts the stopper. The topmost note is held in place by the stopper 150 so the underlying banknote will move relative to the topmost banknote. This process will be repeated for each successive overlapping banknote in the bundle 160. Spring 73*d* ensures that the roller 72*d* engages with successive banknotes of the bundle 160.

In this manner, the roller 72*d* acts on successive overlapping banknotes to superpose the bundle 160.

The transport 26 includes a light transmitter and corresponding sensor (not shown) disposed close to roller 72*d* so that a banknote introduced into the transport will interfere with the light to the sensor and can thereby be detected. The transmitter and sensor are connected to the controller 37 so the controller 37 can determine whether banknotes have been superposed or not (the presence of banknotes indicating that they have not all been aligned). The transmitter and sensor also act to determine if a bundle of banknotes received by the transport 26 from the bundler 28 is mis-registered due to slippage.

If the controller 37 determines, from the readout of the sensor, that the degree of overlap of the banknotes is too great, the controller will operate the transport 26 (in the manner discussed below) to send the overlapping banknotes directly to the cashbox 16 without attempting to superpose them first.

Banknotes of some currencies have different dimensions according to their denomination. To be able to accommodate all banknotes, the distance between the stopper 150 and the roller 72*d* is slightly larger than the length of the largest banknote which the handler 10 may encounter. Therefore, when a bundle of banknotes which are smaller than the largest banknote is received and driven against the stopper 150, the banknotes may not be completely superposed by the process described. However, a reduction in the degree of overlap is important as this ensures that the resultant bundle is easier to store and transport.

Once the controller 37 detects that the overlapping banknotes have been superposed, drive shaft 92 is once again rotated to lower the piston 100 in the third mode of operation of the transport 26. This mode of operation of the transport 26 is illustrated in FIGS. 7A to 7D and corresponds to the configuration illustrated in FIG. 4E.

The rotation of the drive shaft 112 causes the cams 114 to rotate within the recesses 116 and 118 thereby lifting the mobile chassis 70 and the attached rollers 74*b*, 74*c*, 74*d*, 72*b*, 72*c* and 72*d* in the direction of arrows 158 (as previously described). As the piston 100 is lowered it engages the bundle of superposed banknotes 160. The piston 100 has a rubber coating which engages frictionally with the banknote bundle and conveys it downwards. As the mobile chassis 70 has been moved upward simultaneously with the downward movement of the piston 100, the frictional engagement between the belts of the transport and the banknote has been significantly reduced. The increase in the distance between the upper and lower rollers decreases the amount by which the banknotes are bent, also making it easier to move the banknotes downwards.

Figure 7A:
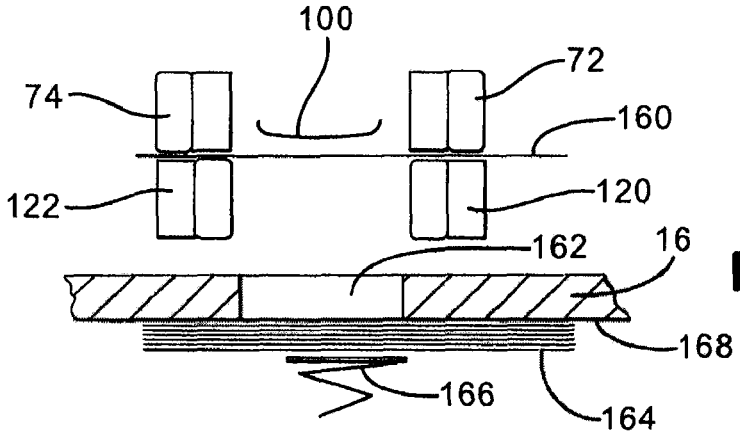
FIGS. 7A to 7D are end views of the transport of FIG. 2 illustrating a further mode of operation of the transport.
Figure 7B:
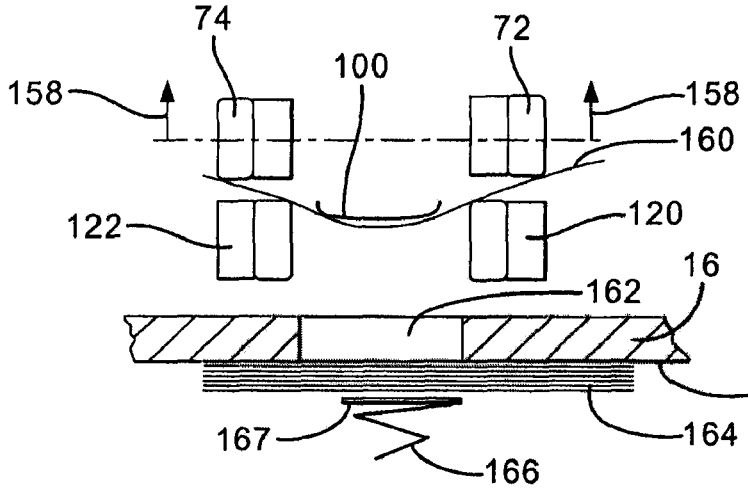
Figure 7C:
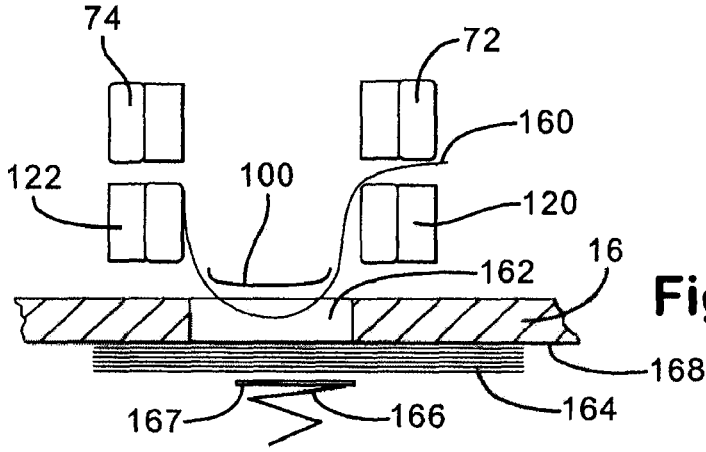
Figure 7D:
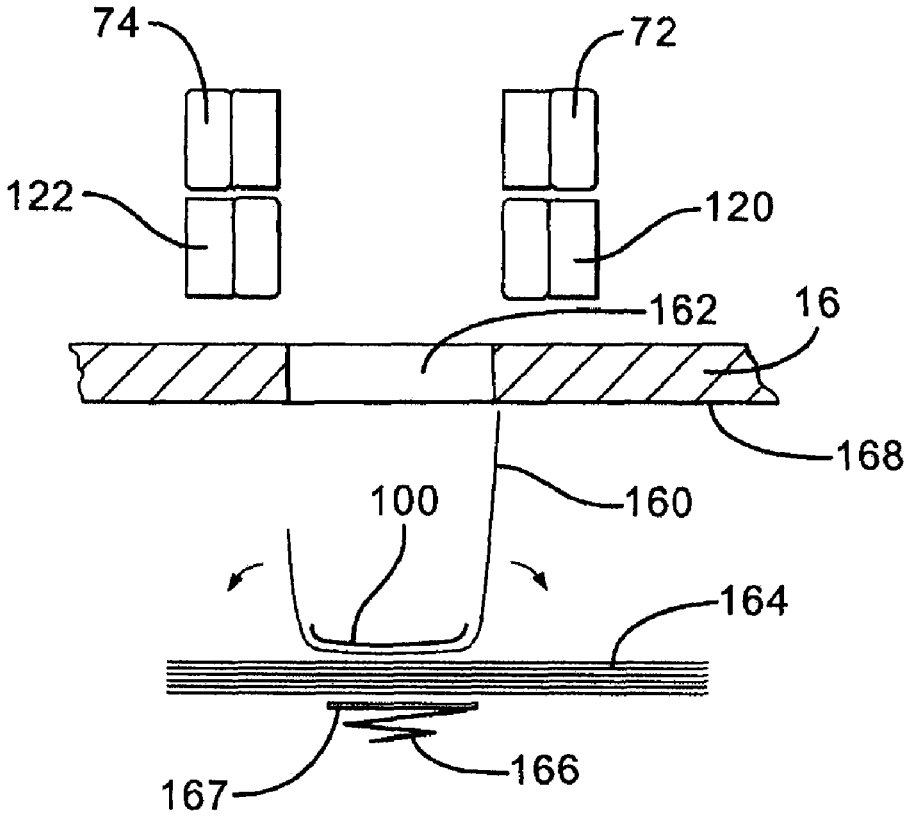

As illustrated in FIGS. 7C and 7D, the piston 100 continues moving downwards through an opening 162 in the cashbox 16 until the bundle 160 engages with a banknote stack 164 stored in cashbox 16. The cashbox 16 includes a spring 166 attached to a pressure plate 167. The banknote stack 164 is supported by the pressure plate 167 and the spring 166 biases movement of the pressure plate 167 upwards so that the topmost banknote of the stack 164 abuts a ceiling 168 of the cashbox 16.

As the bundle 160 encounters the banknote stack 164, the piston 100 acts against the spring 166 moving the banknotes 110 downwards and delivering the bundle 160 into the cashbox 16. Once the piston is raised, the spring 166 moves the bundle 160, now part of the banknote stack 164, upwards until it engages the ceiling 168.

The invention claimed is:

1. A value sheet handling device for a sheet handler, the device comprising:

means for superposing a bundle of value sheets, which includes a stopper and means for driving a bundle of overlapping value sheets against the stopper to increase the superposition of the value sheets of the bundle, wherein the means for driving is arranged such that if a topmost sheet in the bundle overlaps an underlying sheet with a leading edge, the topmost sheet is moved until it abuts the stopper and the means for driving then engages the underlying sheet to move the underlying sheet until the underlying sheet also abuts the stopper in a position below the topmost sheet.

2. The value sheet handling device according to claim 1 wherein the driving means engages frictionally with a topmost banknote of the bundle.

3. The value sheet handling device according to claim 1 wherein the bundle comprises successive overlapping banknotes and the driving means is adapted to progressively engage with successive overlapping banknotes starting with the topmost sheet and subsequently engaging in succession one or more underlying sheets.

4. The value sheet handling device according to claim 1 arranged so the driving means is situated at a distance from the stopper equal to or greater than a length of a longest banknote the device is adapted to handle.

5. The value sheet handling device according to claim 4 wherein the bundle engages with the stopper at a first end of the bundle and the drive means engages with the bundle at, or near, a second end of the bundle, opposed to the first end.

6. A value sheet handle comprising the value sheet handling device according to claim 1 wherein the stopper is moveable between an operational position and a non-operational position so that, in the operational position, the stopper acts to block an outlet of the value sheet handler and acts to superpose overlapping value sheets and, in the non-operational position, permits transport of value sheets to the outlet.

7. The value sheet handling device of claim 1 wherein the means for driving comprises a spring coupled to a roller, wherein the spring acts to push the roller toward the bundle of sheets.

8. A value sheet handler which comprises:

first and second value sheet stores, and a controller configured to control operations of the first and second stores such that the first store is operable to receive value sheets from a user and to dispense value sheets to the user, and the second store is operable to dispense value sheets but does not receive value sheets, the handler being arranged to replenish the first store with value sheets from the second store.

9. The value sheet handler according to claim 8 wherein the second store is removable from the handler.

10. The value sheet handler according to claim 9 wherein the second store is adapted to receive sheets only when removed from the handler.

11. The value sheet handler according to claim 8 wherein the first store is a recycler.

12. The value sheet handler according to claim 7 further including means for determining when value sheets have been misdispensed and a third value sheet store for storing misdispensed value sheets.

13. The value sheet handler according to claim 11 wherein the means for determining when value sheets are misdispensed determines when value sheets have been misdispensed from the second store.

14. The value sheet handler according to claim 8 further comprising means for determining whether a bundle of more than a single value sheet has been dispensed from a value sheet store.

15. The value sheet handler according to claim 14 which includes means for measuring a dimension of the value sheet bundle.

16. The value sheet handler according to claim 15 wherein the measuring means measures a length of the value sheet bundle.

17. The value sheet handler according to claim 14 which comprises means for detecting superposed value sheets which have been dispensed from a value sheet store in a single dispensing operation.

18. The value sheet handler according to claim 17 wherein the means for detecting superposed value sheets is adapted to authenticate value sheets.

19. The value sheet handler according to claim 18 wherein a single value sheet store is used to store value sheets recognised as forgeries and value sheets misdispensed from a dispensing value sheet store.

20. The value sheet handler according to claim 19 wherein the single value sheet store is additionally used to store value sheets received from a user which have passed authentication.

21. The value sheet handling device of claim 1 wherein the means for driving is arranged such that if a topmost sheet in the bundle overlaps an underlying sheet with a trailing edge, the topmost sheet is moved until it abuts the stopper, and either the underlying sheet is conveyed together with the topmost sheet by friction until so that the underlying sheet also abuts the stopper or the means for driving engages the underlying sheet to move the underlying sheet until it too abuts the stopper.

22. The value sheet handler of claim 8 further comprising authenticating means for authenticating value sheets, wherein the first store is operable to receive value sheets authenticated by the authentication means and subsequently to dispense the value sheets received from the second store without further authentication by the authentication means.

23. The value sheet handler of claim 8 further comprising means for determining when value sheets are misdispensed and means for authenticating value sheets, wherein the first store is operable to ensure that a single value sheet is dispensed at a time, the value sheet handler is arranged to replenish the first store with value sheets from the second store that are determined, by the means for determining, to be properly dispensed and that are authenticated by the means for authenticating, and the first store is operable to dispense the value sheets received from the second store without further authentication by the authentication means.

24. A value sheet handling device for a sheet handler, the device comprising:

a first chassis;

a transport system including respective sets of rollers attached to the first chassis and further including upper and lower belts each of which engages with respective ones of the rollers, wherein one or more value sheets are conveyed by being sandwiched between respective pairs of the belts; and a drive system coupled to the first chassis and operable to cause the first chassis to pivot such that at least some of the rollers that engage the upper belts are raised relative to the lower belts and at least some of the rollers that engage the upper belts are lowered, wherein the drive system includes a rotatable drive shaft operable to cause rotation of cams coupled to respective levers that are coupled, respectively, to the first chassis.

25. The value sheet handling device of claim 24 including a second chassis to which each of the levers is coupled, wherein rotation of the drive shaft causes the first chassis to pivot relative to points at which the levers are attached to the second chassis.

26. The value sheet handling device of claim 25 wherein the levers comprise a first pair of levers each, of which is connected to the second chassis at a first pivot point, and a second pair of levers, each of which is connected to the second chassis at a second pivot point.

27. The value sheet handling device of claim 24 wherein the first chassis has an abutment and the second chassis has a plate, wherein the drive system is further operable to cause rotation of the drive shaft such that the first chassis pivots until the abutment of the first chassis is brought into contact with the plate of the second chassis.

28. The value sheet handling device of claim 27 including a controller coupled to the drive system and arranged to cause movement of the first chassis to stop when the abutment of the first chassis comes into contact with the plate of the second chassis.

29. The value sheet handling device of claim 27 arranged such that, once the abutment of the first chassis comes into contact with the plate of the second chassis, further rotation of the drive shaft causes the first chassis to pivot with respect to a point of contact between the abutment and the plate.

30. The value sheet handling device of claim 29 arranged such that when the first chassis pivots with respect to a point of contact between the abutment and the plate, back rollers that engage the upper belts move upward relative to the lower belts.

31. The value sheet handling device of claim 24 wherein the drive system is operable to cause the first chassis to pivot such that back rollers that engage the upper belts are raised relative to the lower belts and front rollers that engage the upper belts are lowered.

* * * * *